US005092829A

United States Patent [19]

Gerber

[11] Patent Number: 5,092,829

[45] Date of Patent: Mar. 3, 1992

[54] METHOD AND APPARATUS FOR BUNDLING AND REMOVING STACKS OF PIECES CUT FROM LAYUPS OF SHEET MATERIAL

[75] Inventor: Heinz J. Gerber, West Hartford, Conn.

[73] Assignee: Gerber Garment Technology, Inc., Tolland, Conn.

[21] Appl. No.: 452,622

[22] Filed: Dec. 19, 1989

[51] Int. Cl.[5] ..... D05B 3/00; D05B 21/00

[52] U.S. Cl. ..... 493/351; 83/941; 227/67; 227/76

[58] Field of Search ..... 53/134.1; 83/29, 76.6, 83/76.9, 90, 91, 102; 227/67, 76; 270/53; 493/351, 375, 376, 384

[56] References Cited

U.S. PATENT DOCUMENTS

| | | | |
|---|---|---|---|
| 3,103,666 | 9/1963 | Bone | 493/375 |
| 3,765,349 | 10/1973 | Gerber | 83/941 |
| 3,830,121 | 8/1974 | Makeey et al. | 83/91 |
| 4,718,158 | 1/1988 | Block | 227/67 |

*Primary Examiner*—William E. Terrell
*Attorney, Agent, or Firm*—McCormick, Paulding & Huber

[57] ABSTRACT

A method and apparatus by which stacks of pattern pieces cut from a layup of sheet material by a cutting tool are bundled and removed from the remaining waste material. A bundler inserts fasteners to bundle at least some of the stacks together and an automatic take-off device removes the bundled stacks from the layup. The cutting tool and bundler are both mounted to a two-axis carriage system and share a common controller with the take-off means. The controller guides the cutting tool around the pattern piece peripheries in response to control data and the bundler inserts fasteners into locations in the layup determined from the same control data. The controller then provides the exact locations of the inserted fasteners to the automatic take-off device which thereafter removes the cut stacks of pieces from the layup. In one embodiment of the invention, identifying information is printed upon the fastener by a printer associated with the bundler to aid in identifying the stacks of pattern pieces.

10 Claims, 6 Drawing Sheets

METHOD AND APPARATUS FOR BUNDLING AND REMOVING STACKS OF PIECES CUT FROM LAYUPS OF SHEET MATERIAL

BACKGROUND OF THE INVENTION

The present invention relates to the automatic cutting of pieces from a layup of sheet material and deals more particularly with a method and apparatus for bundling stacks of cut pieces together with fasteners and for thereafter removing the bundled stacks from the adjacent waste material.

When mass producing garments, upholstery and similar items, it is known to cut pattern pieces from layups of cloth or other flexible sheet material formed by spreading multiple plies of such sheet material on top of one another. A single traversal by a cutting knife of a cutting path having a shape corresponding to the periphery of a pattern piece therefore cuts an entire stack of pattern pieces having the same size and shape. Differently shaped pattern pieces are generally laid out in an optimal fashion over the surface of the layup to maximize usage of the layup material and to leave as little waste material as possible. The cutting knife is often guided around the cutting path by a numerical controller in which the outlines and peripheries of the pattern pieces are defined by data stored on a computer tape or other storage medium.

Many different kinds of cutting tables are known. Since the cutting of the pattern pieces is relatively fast when compared to the spreading of the layup, the layup is usually not spread directly over the cutting table. Instead, the surface on which the pieces are cut may be elongated to provide a separate spreading surface on which the layup can be first spread and then slid onto the cutting surface. The layups are usually spread over an easily slideable sheet material to facilitate later sliding of the layup from surface to surface. After the layups have been cut, they may be slid off the cutting surface and onto a take-off surface or table where the stacks of cut pattern pieces will be removed.

Alternatively, some cutting tables are moveable between several spreading tables on which layups may be simultaneously spread. The cutting table is moved adjacent to a spreading table on which a layup has been spread, the layup is transferred to the cutting table and the layup is then cut. The cut layup is then transferred to a take-off table and the cutting table is moved to the next spreading table with a completed layup. The cutting table can also be moveable relative to several take-off tables, so that after the layup has been cut, the cutting table is moved adjacent to an empty take-off table and the cut layup transferred thereto.

Once stacks of pattern pieces have been cut from a layup, it is customary to individually bundle them to facilitate their future handling and storage. This bundling can be done by manually removing the stacks of pieces and tying them with string or wrapping them with adhesive tape. The stacks can also be automatically bundled while still on the cutting table or similar support by projecting staples or thread stitches through the stacks as disclosed in U.S. Pat. No. 3,765,349 issued on Oct. 16, 1973 to the present assignee.

The degree of automation achieved with known cutting tables makes it desirable to automate the removal process whether the bundled stacks of pattern pieces are removed from the layup on the cutting table or at a later take-off table. Since the exact shapes, sizes and locations of the bundled stacks have already been determined by the cutting tool controller, it is desirable to remove the stacks of pieces with an automatic take-off device or robot that acts in-concert with the cutting tool controller.

In addition, since many different stacks of pattern pieces can be cut from one layup, it is easy to confuse similarly shaped pieces once they are removed from the table. The stacks of pieces are therefore customarily labelled with identifying information to prevent such confusion. Labelling of the stacks of pieces has previously been separate from the bundling step. It is thus desirable to provide a method and apparatus which combine the labelling and bundling steps to reduce the time required and to simplify the apparatus involved.

Accordingly, it is an object of the present invention to provide a method and apparatus by which the cutting tool control means can work in concert with an automatic take-off device to facilitate removal of the stacks of pieces after a cutting operation.

It is a further object of the present invention to provide a method and apparatus which combines the bundling and labelling of cut stacks of pieces.

It is still another object of the present invention to provide a method and apparatus by which the bundling and labelling of cut stacks of pieces is performed in response to data provided by the cutting tool control means.

SUMMARY OF THE INVENTION

The present invention resides in a method and apparatus for bundling and removing stacks of pieces cut during a cutting operation from a layup of sheet material. As a result of the cutting operation, the layup of sheet material is divided into stacked pattern pieces and waste material. The apparatus includes a cutting means having a cutting tool, with the cutting means and the layup being moveable relative to one another. A bundling means is also moveable relative to the layup and inserts fasteners into the layup to hold the stacks in a bundled condition. The fasteners after insertion have head portions extending upwardly beyond the layup. A take-off means thereafter grasps the head portions of the inserted fasteners to remove the bundles from the support surface and to transfer them elsewhere. The bundling means may also include means for applying information to the head portions of the fasteners as they are inserted so that such heads thereafter serve as labels identifying the bundles.

DESCRIPTION OF THE PREFERRED EMBODIMENTS

Figure 1:
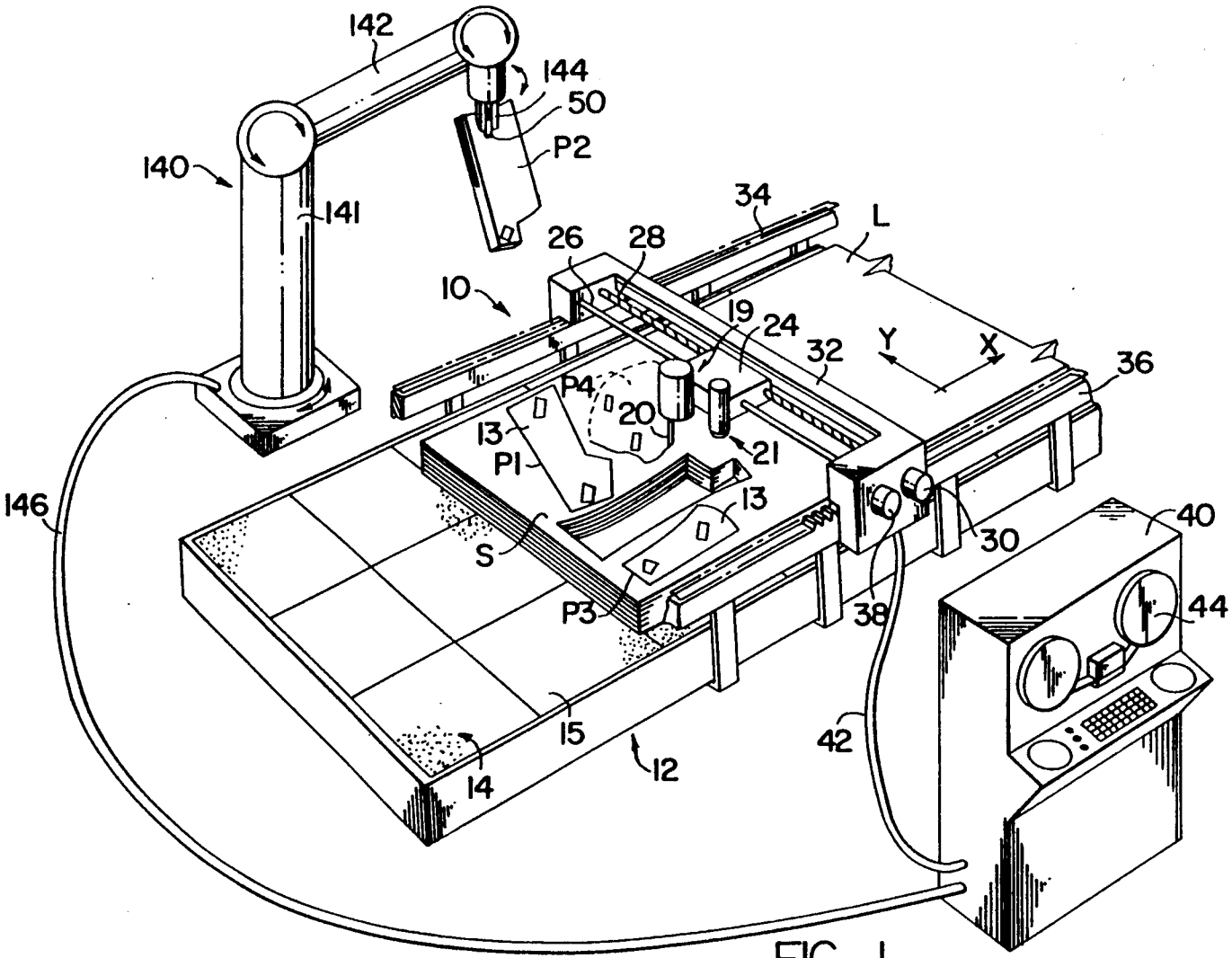
FIG. 1 is a perspective view of a cutting apparatus having a bundling means and an automatic take-off means in accordance with the present invention.

FIG. 1 is a perspective view of an automatically controlled cutting, bundling and take-off apparatus embodying the invention. The cutting and bundling apparatus is indicated generally at 10 and the take-off apparatus is indicated generally at 140. The apparatus 10 includes a support table 12 having a support surface 14 upon which a layup L of sheet material is spread so that stacks 13 of pattern pieces P1, P2, etc. may be cut from the layup by the cutting means of the apparatus 10. The portion of the layup not constituting pattern pieces F is usually considered waste S and discarded after the cutting operation.

The support surface 14 may be provided in many different ways without departing from the broader aspects of the invention, but preferably and as illustrated it is provided by a penetrable bed 15 formed by contiguous bristle blocks or mats or by contiguous blocks of foam material. If desired, one or more vacuum chambers can also be provided beneath the penetrable bed and air passages provided through the bed so that the layup L can be compressed and firmly held against the surface 14 during a cutting operation, and also if desired during a bundling and labelling operation, by use of an overlying layer of air-impermeable material. A more detailed description of such a vacuum hold-down table which may be used as the table 12, may be found in U.S. Pat. No. 3,495,492 issued Feb. 17, 1970 to the assignee of the present invention.

The apparatus 10 also includes a cutting means 19, with a vertically reciprocating cutting tool 20, and a bundling means 21 both supported above the surface 14 for movement parallel thereto in the illustrated X and Y coordinate directions by a Y-carriage 24. The Y-carriage 24 is moveable in the illustrated Y direction relative to an X-carriage 32 by a guide bar 26 and lead screw 28 forming part of the X-carriage 32. A drive motor 30 rotates the lead screw 28 to drive the Y-carriage in the Y-direction along the guide bar 26.

The X-carriage 32 is moved in the illustrated X direction by pinions (not shown) on the X-carriage 32 meshing with a pair of racks 34 and 36 on opposite sides of the table. The pinions are rotated by a drive motor 38. Coordinated movement of the X and Y-carriages thus allows the cutting means 19 and bundling means 21 to be positioned anywhere over the support table 14. It should be understood, however, that it is not necessary that both the cutting means 19 and the bundling means 21 be carried by the same Y-carriage, and if desired, a separate Y-carriage and an associated separate X-carriage may be provided for each of the cutting means 19 and bundling means 21 to permit each of said means to move independently of one another.

Many different ways of providing the take-off means 140 exist within the scope of the present invention such as virtually an computer controlled mechanical arm or robot device capable of seizing a bundle and transferring the bundle between locations, that is between the position at which the bundle is picked up and a delivery station such as a bin or take-away conveyor. The take-off means 140 as illustrated in FIG. 1, preferably includes pivotable arms 141, 142 and a swivelling claw 144 which is operable to pick up objects much like a human hand. By appropriate pivoting of the arms 141 and 142, the claw 144 can be positioned over any location on the cutting table 12 to seize fasteners inserted in the layup L and to remove the associated bundle of pieces.

The drive motors 30 and 38, the cutting means 19 and the bundling means 21 are operated by a controller 40 via a cable 42. Likewise, the take-off means 140 is also operated by the controller 40 via a cable 146. The controller 40 thus controls the cutting tool path, the locations in which the bundling means 21 inserts the fasteners and the removal of the bundled stacks by the take-off means. Since the bundling means 21 and the take-off means 140 share the controller 40 the information defining the locations at which the bundling means 21 inserts the fasteners can also be used (with possibly the addition of offsets) to control the positioning of the take-off means for the removal of the bundled stacks. Furthermore, since the bundling means 21 and cutting means 19 also share the controller 40, it is possible to derive the fastener insertion locations from the control data defining the cutter tool path. Alternatively, the fastener insertion locations may also, if desired, be precomputed manually, or with the aid of a computer, for example during the making of the marker defining the cutter tool path, and fed to the controller along with the tool path information.

The controller 40 is advantageously of the numerical control type in which the cutter tool path, including the outlines or peripheries of the pattern pieces to be cut, and other related information, is defined by pre-existing data, derived in the marker making process, stored on a computer tape 44 or other storage medium. However, "on-line" controllers in which more temporary control data is interactively generated by an operator at the controller 40 or at a remote terminal can also be used with the present invention.

To start a cutting operation, the cutting means 19 is positioned at a starting location by the interaction of the X and Y-carriages 24 and 32. The cutting tool 20 is then lowered towards the layup L and reciprocated on the tool axis to cut into the layup L. Carriages 24 and 32 then move the cutting tool 20 along a cutting path including the peripheries of the pattern pieces to be cut. After a cutting operation is complete, the cutting tool is raised from the layup L.

Either before or after the cutting operation, the bundling mean 21 bundles the individual sheets comprising each stack of pattern pieces P together with fastening means. The fasteners provide a convenient hold by which the bundled stacks of pieces may be automatically or manually lifted off the table. In the preferred embodiment of the invention, the bundling means 21 includes a means for applying information to the fasteners as they are inserted in the layup. The applied information on the fasteners assists in later identification of the bundled stacks.

After the numerical controller 40 calculates or otherwise obtains the co-ordinates where fasteners are to be inserted in the layup, the co-ordinates are stored in a computer memory for later use with the take-off means. That is, after a desired number of stacks of pieces P2 have been cut from the layup and fasteners inserted by the bundling means, the controller 40 later retrieves the stored location of the fasteners one at a time from memory and for each such retrieval uses the fastener location information to position the claw 144 over the associated fastener 50. The take-off claw 144 then picks up the entire associated stack of pieces P2 by the fastener 50. The cut pattern pieces can thus be efficiently separated from the waste material at any time after a cutting operation is complete. The take-off means 140 can either remove the stacks of pieces as they are cut or at a later time. The take-off means may also be positioned adjacent the cutting station so the layup need not be moved between cutting and take-off of the cut stacks, or may be positioned at a take-off station remote from the cutting station and to which the layup is moved after cutting. After the take-off means picks up a bundled stack, it transfers such stack to an associated delivery station, such as a bin or take-away conveyor, and then releases the bundle, allowing it, for example, to fall into the receiving bin or onto the take-away conveyor. In one embodiment of the invention, the automatic take-off means 140 includes optical sensing means to read the information applied to a fastener so that it can then remove the associated stack of pieces to a selected one of a number of available delivery stations on the basis of such information.

Although in the preferred embodiment both the cutting means 19 and the bundling means 21 are mounted to the same carriage, it should be understood that entirely separate means for independently translating the cutting means 19 and the bundling means 21 relative to the support surface 14 can also be used. Also, the present invention can be used where the spreading, cutting and take-off of the cut stacks are performed at different stations. If such different stations are used, the bundling means 21 may be located either at the cutting station with the cutting means or at the take-off station with the take-off means.

Figure 5A:
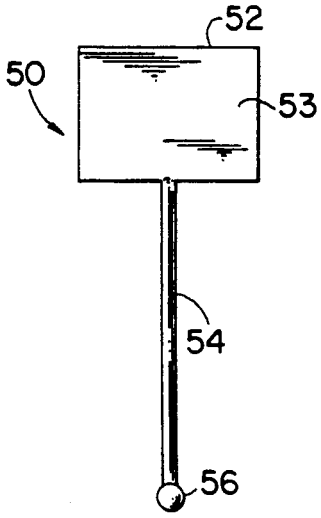
FIG. 5*a* is a front view of a plastic fastener for use in the bundling means of FIG. 2.
Figure 5B:
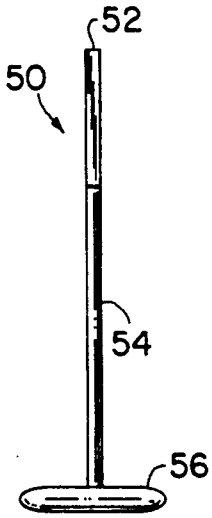
FIG. 5*b* is a side view of the fastener of FIG. 5*a*.
Figure 5D:
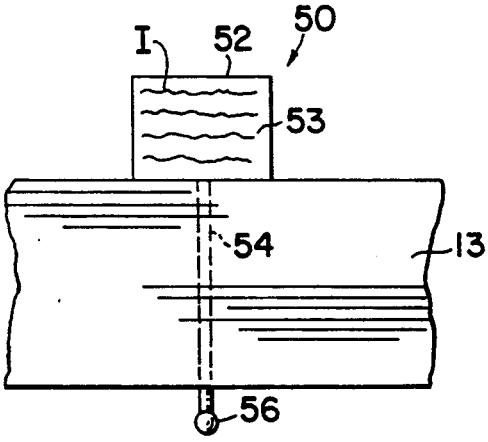
FIG. 5*d* is a cross-sectional view of a layup of material held together by fasteners such as those of FIG. 5*a*.

While many ways of fastening the layers together exist, in accordance with one aspect of the invention the bundling means advantageously dispenses plastic fasteners generally similar to the kind commonly used to attach price tags or the like to clothing articles. FIGS. 5*a* and 5*b* show such a one-piece plastic fastener at 50. The upper end of the fastener 50 has a wide planar head 52 with a surface 53 suitable for printing upon. A flexible fiber 54 joins the head to a T-bar 56 that is normally generally transverse to the plane of the printing surface 53. FIG. 5*d* shows a fastener 50 bundling together the layers of a pattern piece stack 13. The fiber 54 passes through the stack 13 and the T-bar is positioned horizontal to and immediate to the bottom layer of the stack. The head 52 is positioned adjacent and extends above the top layer of the stack. The stack 13 therefore can be conveniently picked up by the head 52 and the surface 53 can receive identifying information.

Figure 5C:
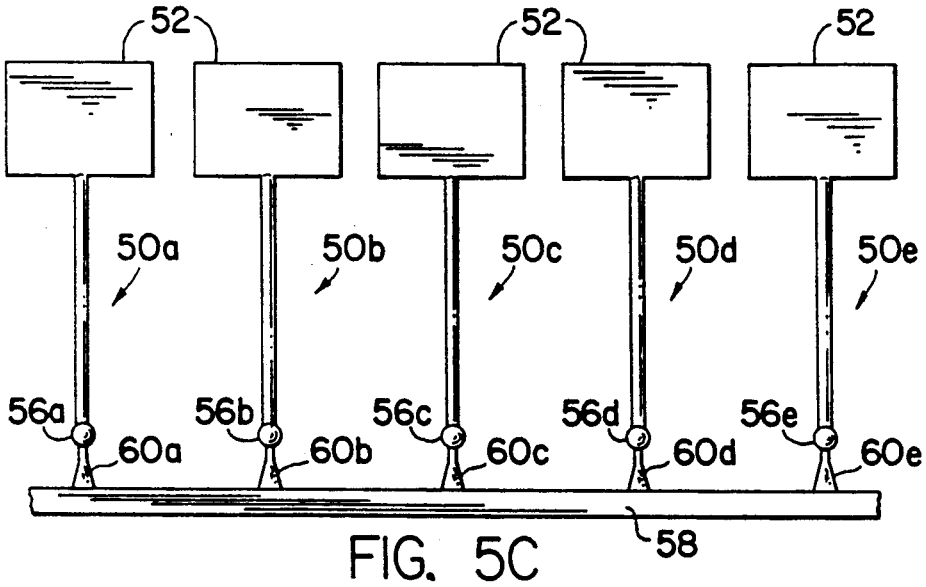
FIG. 5*c* shows several of the fasteners of FIG. 5*a* releasably joined together for automatic feeding through a dispenser.

To facilitate feeding and insertion of the fasteners 50, it is advantageous to form a chain of interconnected fasteners as shown by 50*a*, 50*b*, 50*c*, etc. in FIG. 5*c*. The T-bar 56 of each fastener 50 is connected to a common plastic bar 58 by a thin or tapered connecting piece 60*a*. Each connecting piece 60*a*, 60*b* etc. is strong enough to initially hold the T-bar 56 perpendicular to the bar 58 but weak enough to shear when a predetermined force is applied between the bar 58 and one end of the associated T-bar 56*a*, 56*b*, etc. The interconnected fasteners 50*a*, 50*b*, etc., the associated joints 56*a*, 56*b* and the plastic bar 58 are all ideally formed from one piece of plastic to minimize manufacturing costs.

Figure 2:
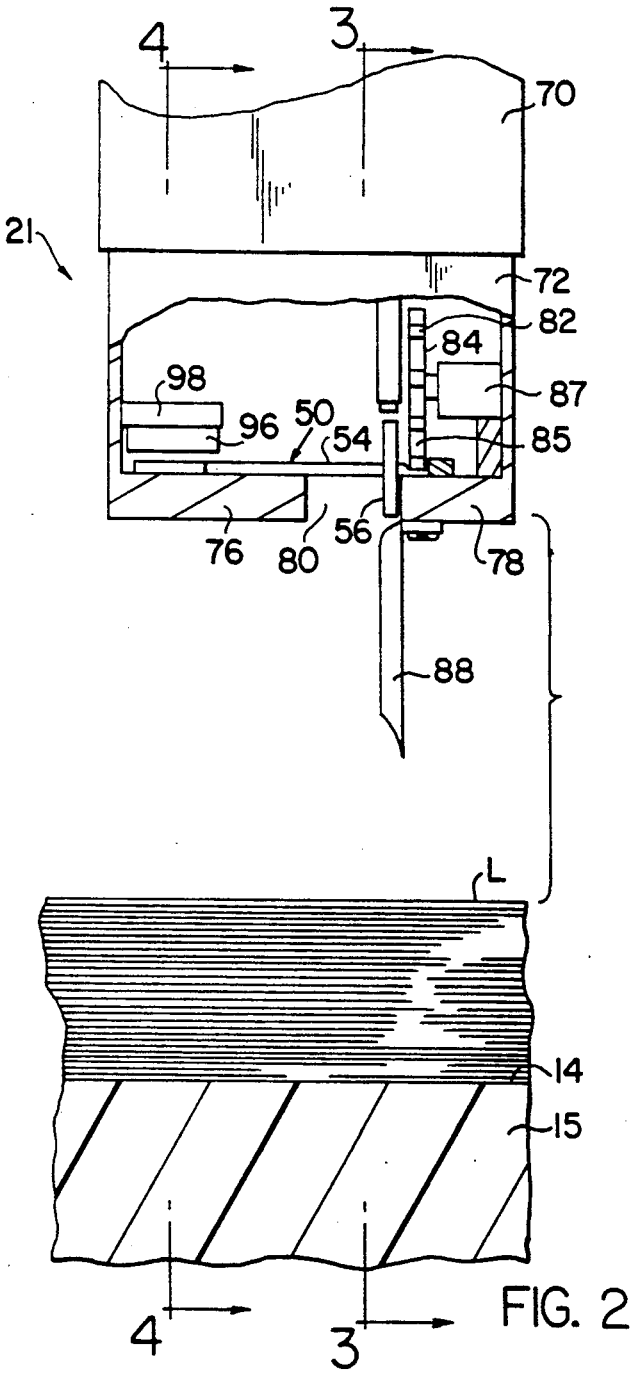
FIG. 2 is a front elevational view of the bundling means of FIG. 1.
Figure 3:
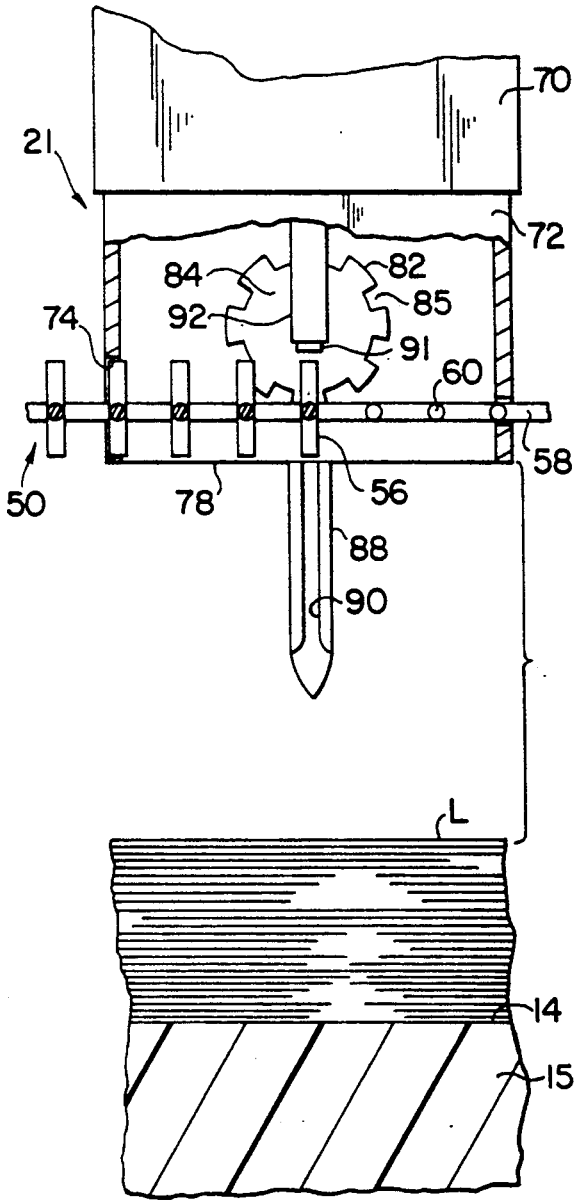
FIG. 3 is a side elevational view of the bundling means taken on the line III—III of FIG. 2.
Figure 4:
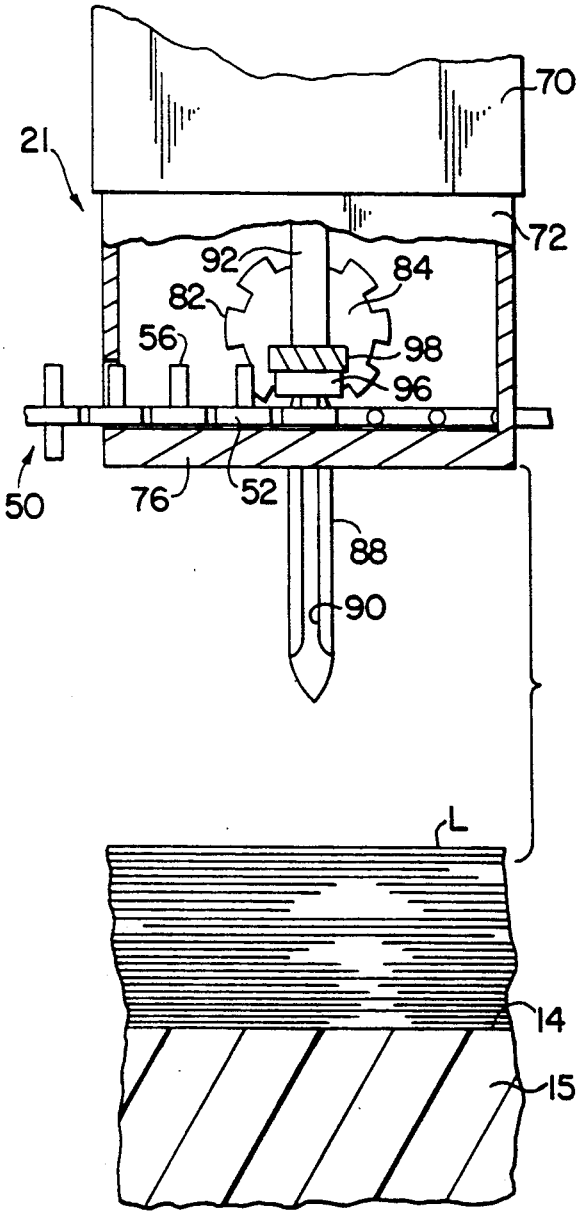
FIG. 4 is a side elevational view of the bundling means taken on the line IV—IV FIG. 2.

Reference is now made to FIGS. 2–4 for a more detailed discussion of the bundling means 21. This bundling means includes both a bundler for inserting fasteners and a printer for printing on the fastener heads, and it is mounted to the Y-carriage 24 by a mounting bracket 70. The housing 72 of the bundling means is connected to the bracket 70 by a reciprocating platform (not shown) so that the housing 72 may be moved into and out of contact with the layup L. A chain of fasteners 50 is fed into the housing 72 through an opening 74. The base of the housing 72 is divided into two halves 76 and 78 which function as support shoulders for the chain of fasteners 50. The plastic bar 58 and the printing surface 53 of the fasteners rest on support shoulders 76 and 78 respectively. A T-bar 56 is thus suspended in the gap 80 between the two shoulders 76 and 78.

The chain of fasteners 50 is advanced by a wheel 84 having teeth 82 and driven by an incremental drive motor 87. The gaps 85 between the teeth 82 are separated from one another by a distance equal to that between the connecting pieces 60 connecting the fasteners 50 to the bar 58. A connecting piece 60 fits in each gap 85 so that as the wheel 84 rotates, the connecting pieces 60 feed one-for-one into a corresponding gap 85 thus allowing the teeth 82 to advance the chain of fasteners 50. The wheel 84 and its teeth 82 rotate an identical distance each time the chain of fasteners 50 is advanced due to the motor 87 being one which turns a measured increment or "step" per energization and which is energized and de-energized under control of the controller.

A hollow needle 88 projects downwardly from the gap 80 between the shoulders 76 and 78. The interior of the needle 88 defines a channel 90 slightly wider than the flexible fiber 54 of the fastener 50. The hollow portion of the needle 88 extends the entire length of the needle so that both needle ends are completely open.

A fastener 50 to be dispensed is advanced by rotating the wheel 84 until its T-bar 56 is above, and axially aligned with, the needle 88 as best seen in FIG. 3. A pushrod 91 within a guide 92 is normally located above the needle 88 and can be reciprocated so as to move downwardly through the needle to push the fastener T-bar 56 along the entire length of the needle bore. The lower end of the pushrod 91 is slightly dished so as to entrap the upper end of the fastener T-bar 56 as it moves downwardly.

Referring to FIG. 4, the fastener head 52 rests on the shoulder 76 adjacent to the needle. Above the head 52, a printing unit 96 reciprocates relative to the head 52 within a bracket 98 attached to the housing 72. To print on the surface 53 of the head 52, the printing unit 96 moves down to contact the surface 53 and prints identifying markings on it. The printing unit 96 may be of any known kind such as thermal transfer, dot matrix, ink jet etc. The information printed on the fastener 50 can range from bar codes and computer readable codes to man-readable alphanumeric characters. The printing head 96 could also be mounted beneath the fastener printing surface 53 so that no movement of the unit 96 is necessary. Furthermore, the printing unit 96 could be replaced by a label applicator for applying printed labels to the surface 53.

Figure 6:
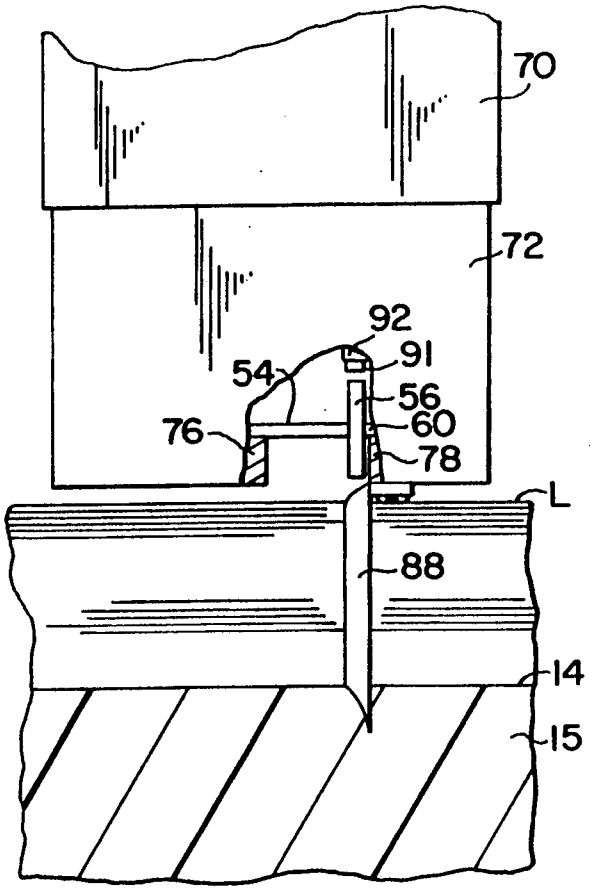
FIG. 6 is a side view of the bundling means of FIG. 2 penetrating into a layup of sheet material and showing the needle thereof.

Once the printing or labelling of the fastener printing surface 53 is completed, the fastener 50 is ready to be inserted into the layup L. Referring to FIG. 6, the entire housing 72 moves down to the layup L until the open end of needle 88 has fully penetrated the layup L and part of the penetrable bed 15. The printing unit 96 is raised away from the fastener printing surface 53. The pushrod 90 is then moved downwardly, after a short portion of this movement the upper end of the T-bar 56 seats in the dished lower end of the pushrod which then applies downward force on the T-bar 56. The associated connecting piece 60 then shears due to the downward force applied to it and frees the fastener 50 from the chain bar 58.

Figure 7:
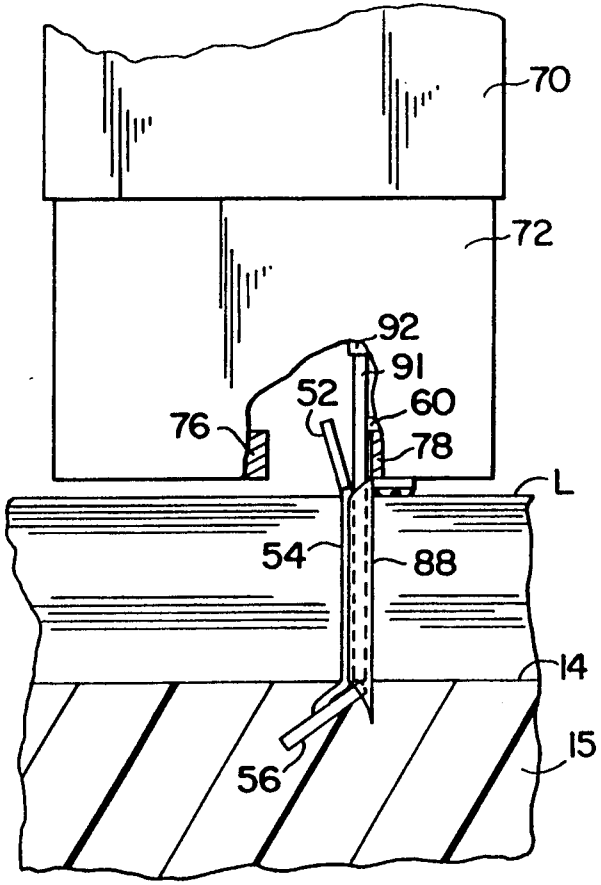
FIG. 7 is a side view similar to FIG. 6 but showing its bundling means in a later stage of its operation in which the transverse T-bar of the plastic fastener has been pushed through the layup.

Referring now to FIG. 7, the pushrod 90 then continues its downward movement to push the T-bar 56 down through the hollow needle 88 and through the layup L. The flexible fiber 54 is pulled along with the T-bar 56 but at an angle making it lie generally parallel to the T-bar. The head 52 is pulled off the shoulder 76 and toward the needle 88 by the flexible fiber 54. At the end of its downward stroke the pushrod 91 pushes the T-bar 56 out of the needle bore 88 and into the penetrable surface 14, the flexible fiber 54 and T-bar 56 resume their original perpendicular relationship and the T-bar emerges from the needle 88 horizontal to the layup L as seen in FIG. 7. The layers in the layup L are thus fastened together by virtue of the T-bar 56 being located below the layup L and being connected by the flexible fiber 54 to the head 52 located above the layup. The housing 72 is then raised until the needle 88 withdraws from the layup L and the assembly 21 assumes the position shown in FIGS. 2–4. Wheel 84 then rotationally increments so that the chain of fasteners 50 advances and another fastener 50 is positioned with its head underneath the printing unit 96 and the T-bar 56 above, and axially aligned with, the needle 88. The bundling means 21 can now be relocated to another part of the layup L to insert a second fastener 50 using the same steps as described above.

Figure 8:
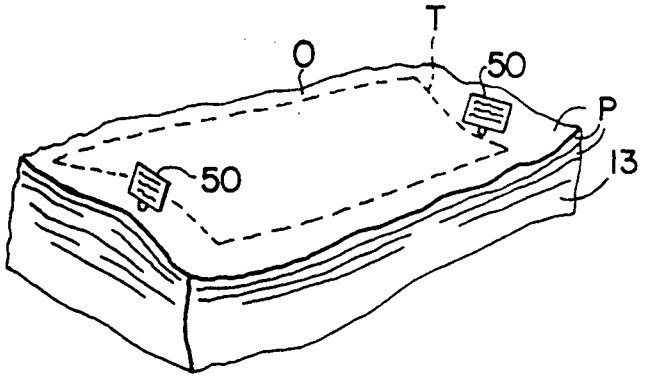
FIG. 8 is a perspective view of a stack of pieces joined together by fasteners in accordance with the present invention.

The printing and bundling operations described above can be performed either before or after the cutting operation. Any number of fasteners can be used to bundle the stacks of pieces together. In some cases, it might be desirable to also insert fasteners into the waste material. Referring to FIG. 8, an example of a stack 13 of pattern pieces P fastened with two fasteners 50 is shown. In this illustrated case, a small region 0 is indicated around the periphery of the pattern pieces P which is located between the periphery of the pattern pieces and the line T along which the pattern piece is subsequently sewn, so that in a finished garment the region 0 is hidden from view. It is desirable to place the fasteners 50 within the region 0, as shown, so that any possible marring of the material by the fasteners will not be visible in the finished product.

Figure 9A:
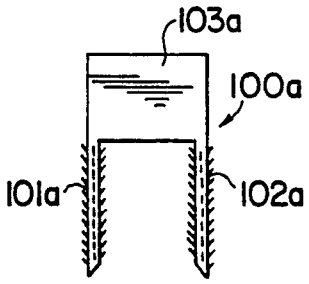
FIG. 9*a* shows a two prong barbed staple for use with apparatus comprising another embodiment of the invention.
Figure 9B:
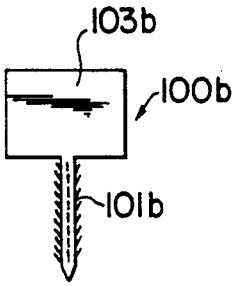
FIG. 9*b* shows a one prong barbed staple for use with apparatus comprising another embodiment of the invention.

In another embodiment of the present invention, other means for labelling and bundling stacks of material are the barbed staples 100*a* and 100*b* of FIGS. 9*a* and 9*b*. The barbed legs 101*a* and 102*a* on the staple 100*a* penetrate through the entire layup L The barbs on staple legs 101*a* and 102*a* hold the material layers together while a head 103*a* printing surface remains above the material to display information applied to the head and to provide a means by which a stack of pieces in which it is inserted can be lifted. Likewise, the staple 100*b* has a head 103*b* with a printing surface but has only one leg 101*b* with barbs.

Figure 10:
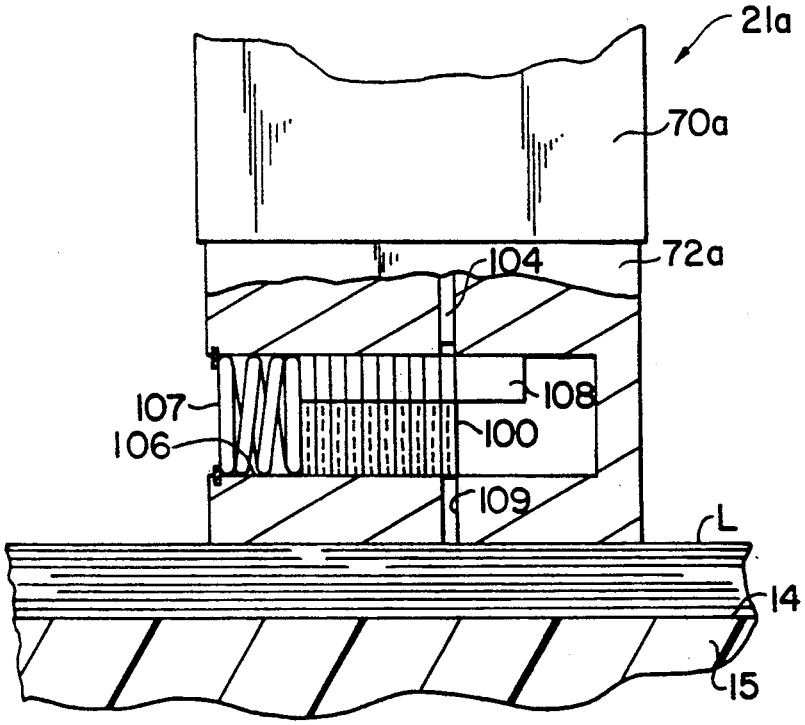
FIG. 10 is a side elevational view of a bundling means which may be substituted for that of FIG. 1 and used with the fasteners of FIGS. 9*a* and 9*b*.

Referring now to FIG. 10, an apparatus 21*a* is there shown that is suitable for printing upon and dispensing staples 100*a* and 100*b*. A housing 72*a* reciprocates within a mounting bracket 70*a*. A pushbar 104 reciprocates relative to the housing 72*a* within a guide 106. Staples 100 are entered into the housing 72*a* through a conduit 106 that transversely intersects the guide 106. Preferably the staples are joined together in a contiguous strip such as 105 and then biased by a spring 107 into the housing 72*a*. A printing unit 108 is mounted to the housing adjacent the guide 109 and opposite the conduit 106. One staple 100 enters the guide 106 at a time and is indirectly biased by the spring 107 against the printing head 108. Information is then printed on the printing surface of the head 103 of the staple 100 by the printing unit 108. The pushbar 104 then reciprocates downwardly in the guide 106, separates the staple 100 from the strip 105 and drives the staple 100 down and out of the guide 106 and through the layup L. The barbs on the staple leg(s) hold the individual layers of the layup together and the head 103 remains above the surface of the layup L with the printed information visible. Of course a label dispenser as mentioned above could be used to instead place labels on the head 103 of the staples 100.

Once stacks 13 of pattern pieces P have been cut, labelled and fastened with staples 100, the individual layers of material of each stack may be easily separated from the stack by pulling them off the stack from the side opposite to the head 103 without removing the associated staple 100. If all the layers in a bundle of pattern pieces are not needed at once, the needed layers can be pulled from the bottom of the bundle without need for refastening or relabelling the remaining layers.

Figure 11:
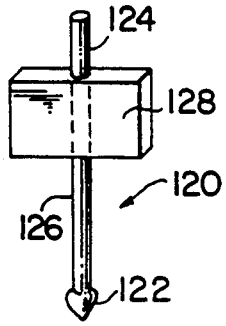
FIG. 11 shows a pop-rivet type fastener for use with an apparatus comprising still another embodiment of the invention.

Referring now to FIG. 11, a fastener for use in another embodiment of the invention is shown generally at 120. The fastener 120 is in the nature of a "pop-rivet" and has a pointed insertion head 122 connected to a rod 124. The rod 121 is slidably contained within a tube of soft material 126 having a diameter less than the diameter of the head 122. A main head 128 is attached to the upper end of tube 126. Pulling up on the rod 124 causes the insertion head 122 to mushroom the lower end of the tube 126 outwardly. The fastener is used by first printing, if desired, appropriate information on the main head 128 and then pushing the insertion head 122 through the layup. The rod 124 is then pulled up to mushroom the head 122 to thereafter hold the layers of the layup together as a bundle between the main head 128 and the mushroomed lower end of the tube 124.

It is to be understood that the invention is not limited to the illustrations described and shown herein, which are merely illustrative of the best modes of carrying out the invention and which are susceptible of modification in form, size, arrangement of parts and details of operation. For instance, an embodiment of the invention is conceivable where the heads of the fasteners contain a ferro-magnetic material. The bundled material of the layup could then be removed either automatically or manually by a magnetic removal system. Furthermore, the present invention can be used when cutting with only one layer or a few layers of sheet material to facilitate handling and future identification. The printing unit could also be separate from the fastener inserter and could print on the fasteners either before or after they are inserted in a layup. The invention thus is intended to encompass all such modifications which are within its spirit and scope as defined by the claims.

I claim:

1. An apparatus for forming bundles of stacks of pieces cut by a cutting operation from a layup of sheet material, and for removing such bundled stacks from the remainder of the layup, said apparatus comprising:

a cutting means having a cutting tool and operable to cut stacks of pattern pieces from a layup of sheet material;

a bundling means moveable relative to said layup of sheet material for inserting fasteners into said layup to hold stacks of pattern pieces cut from said layup in bundles, a take-off means for thereafter seizing said inserted fasteners to remove stacks of pattern pieces bundles thereby from the layup and to transfer them elsewhere, support means having a support surface for supporting said layup of sheet material, an automatic controller for providing control data and deriving fastener locations from said control data, and having a computer memory for storing said fastener locations, said controller controlling said cutting means, said bundling means and said take-off means, and wherein said automatic controller includes means for instructing said cutting tool of said cutting means to guide said tool around the peripheries of said pattern pieces on the basis of said control data provided by said controller, for instructing said bundling means to insert said fasteners into said layup at said locations derived from said control data, and for instructing said take-off means to seize said fasteners from said stored fastener locations retrieved from said computer memory.

2. The apparatus of claim 1 further including means for applying information to a fastener to identify the stack of pattern pieces with which said fastener is associated.

3. The apparatus of claim 1 further characterized in that said fasteners after insertion have heads extending upwardly beyond said layup for seizure by said take-off means.

4. The apparatus of claim 3 wherein said bundling means include a means for applying information to said fastener heads.

5. The apparatus of claim 4 wherein said means for applying information comprise a printer.

6. The apparatus of claim 3 wherein said head of each fastener is generally planar and wherein each fastener also includes:

a transverse bar normally disposed generally perpendicular to said head, and a flexible fiber connecting said head to said transverse bar.

7. The apparatus of claim 3 wherein said head of each of said fasteners is generally planar and wherein each fastener also includes at least one rigid leg for insertion through a layup.

8. The apparatus of claim 7 wherein said at least one rigid leg has a pointed insertion portion at its end remote from said head which insertion portion can be mushroomed to fasten the layers of a layup together between the mushroomed end and the head.

9. A method for bundling and removing stacks of pieces cut during a cutting operation from a layup of sheet material on a support surface wherein after said cutting operation, said layup of sheet material is divided into stacks of pattern pieces and waste material, said method comprising the steps of:

cutting stacks of pattern pieces from a layup of sheet material, inserting fasteners into said layup to hold said stacks in bundles, seizing said fasteners to remove said bundles from said layup and to transfer them elsewhere, using an automatic controller to provide control data and derive fastener locations from said control data, and using a computer memory of said automatic controller to store said fastener locations, said pattern pieces being cut from said layup by guiding a cutting tool around the peripheries of said pattern pieces on the basis of said control data provided by said controller, said fasteners being inserted into said layup at said locations derived from said control data, and said fasteners being seized by retrieving said stored fastener locations from said computer memory and positioning a take-off mechanism at said fastener locations, by using said controller to drive said take-off mechanism.

10. The method of claim 9 further including the step of printing information upon at least some of said fasteners to thereby identify the stacks associated with said fasteners.

* * * * *